US005414435A

United States Patent [19]

Wolf

[11] Patent Number: 5,414,435

[45] Date of Patent: May 9, 1995

[54] SPACE FRAME SATELLITE DISH AND AIMER SUPPORT

[75] Inventor: James S. Wolf, Sturbridge, Mass.

[73] Assignee: Wolf Coach, Inc., Auburn, Mass.

[21] Appl. No.: 207,930

[22] Filed: Mar. 8, 1994

[51] Int. Cl.[6] ..... H01Q 1/32; H01Q 1/12

[52] U.S. Cl. ..... 343/713; 343/711; 343/878; 280/762

[58] Field of Search ..... 343/713, 711, 712, 878, 343/890, DIG. 2; 280/762; H01Q 1/32, 1/12, 1/22, 1/27

[56] References Cited

U.S. PATENT DOCUMENTS

| | | | |
|---|---|---|---|
| 2,469,102 | 5/1949 | Breisch et al. | 343/713 |
| 3,412,404 | 11/1968 | Bergling | 343/762 |
| 4,063,633 | 5/1987 | Wilson | 343/714 |
| 4,101,897 | 7/1978 | Morrison | 343/715 |
| 4,309,708 | 1/1982 | Sayovitz | 343/713 |
| 4,811,026 | 3/1989 | Bissett | 343/766 |

FOREIGN PATENT DOCUMENTS

| | | | |
|---|---|---|---|
| 2204448 | 8/1973 | Germany | 343/713 |
| 55-34550 | 3/1980 | Japan | 343/713 |
| 3-34705 | 2/1991 | Japan | H01Q 1/32 |

*Primary Examiner*—Donald Hajec
*Assistant Examiner*—Hoanganh Le
*Attorney, Agent, or Firm*—Nields & Lemack

[57] ABSTRACT

Communications vehicle including a roof-mounted satellite dish that is effectively and efficiently supported by a combination of structural components so as to allow for the maximization of operator compartment space in the vehicle without a concomitant increase in vehicle dimensions. A plurality of racks for housing electronics, access to which is required from the vehicle operator compartment, are designed as structural supports, in combination with other structural components, for the satellite dish and aimer assembly. The combination transmits the satellite dish and aimer assembly load through the structure and finally to the ground.

4 Claims, 18 Drawing Sheets

SPACE FRAME SATELLITE DISH AND AIMER SUPPORT

BACKGROUND OF THE INVENTION design and construction of communication vehicles for receiving and/or transmitting signals requires consideration of numerous parameters, many depending upon the particular application to which the vehicle is being put. For example, weight and balance, axle loading, generator enclosure, roadability, safety and weather integrity must be carefully considered for each vehicle being designed and built. Similarly, such design considerations may be of concern for mobile homes, recreational vehicles, trailers, etc. that utilize satellite antenna systems.

In particular, efficient utilization of space inside the compartment of a communication vehicles is of the utmost importance. The vehicle compartment must house all of the necessary electronic equipment, as well as have sufficient space for one or more operators of the equipment. These space constraints are limited by federal and state regulations, which dictate the maximum height and width such vehicles can comprise.

Further limiting the variables which can be modified in order to create compartment space is the location of the satellite dish and dish aimer on the vehicle roof. Such satellite dishes are well known; they are commonly used with communication vehicles as part of a mobile television operation. The dish antenna serves as a parabolic reflector for concentrating the energy of a microwave signal, for example, received from a satellite terminal. Once the parabolic dish of the antenna is aimed and focused on the satellite, the antenna should retain pointing accuracy for effective transmission and reception of the signals. Accordingly, the dish must be rigid and solidly mounted on the vehicle, and must be coupled to suitable aiming apparatus.

In view of the foregoing, it can be easily understood that the weight of the dish and aimer apparatus, which can be excessive, requires substantial support when mounted on the vehicle roof. Exposure to external forces such as wind, especially when the vehicle is moving, further complicate the problem. The weight of the apparatus, therefore, severely limits the alternatives of where it can be located on the vehicle roof.

FIG. 1 illustrates a conventional communications vehicle having a satellite dish 13 mounted on its roof. The frame of the vehicle under the dish must be suitable constructed to support the dish. To that end, rear vehicle wall 15 and structural wall 14 are designed to support the dish 13 through the dish base 16. Electronics racks 17 are positioned to permit ready access to the electronics housed therein from the operator compartment 12. This design results in the space in operator compartment 12 being severely limited. The vehicle shown has a height of 12'-7" and a width of 7'-10.25". The dimensions of the operator compartment are 79" H×89.25 W×92.75" D.

It is therefore an object of the present invention to provide a vehicle with increased work space for a given vehicle length, width and height.

It is a further object of the present invention to provide structural support for a roof-mounted satellite dish and aimer assembly that is a combination of the frame of the vehicle and the electronics racks, thereby maximizing the available space of the operator compartment.

SUMMARY OF THE INVENTION

The problems of the prior art have been solved by the present invention, which provides a communications vehicle including a roof-mounted satellite dish that is effectively and efficiently supported by the combination of structural components, thereby allowing for the maximization of operator compartment space without a concomitant increase in vehicle dimensions. More specifically, the electronics racks are designed not only as a housing for the electronic components necessary for the communications applications of the vehicle, but also as structural supports, in combination with other structural components, for the satellite dish and aimer assembly. The combination transmits the satellite dish and aimer assembly load through the structure and vehicle frame to the vehicle chassis and supporting jacks, and then to the ground.

DETAILED DESCRIPTION OF THE INVENTION

Figure 1:
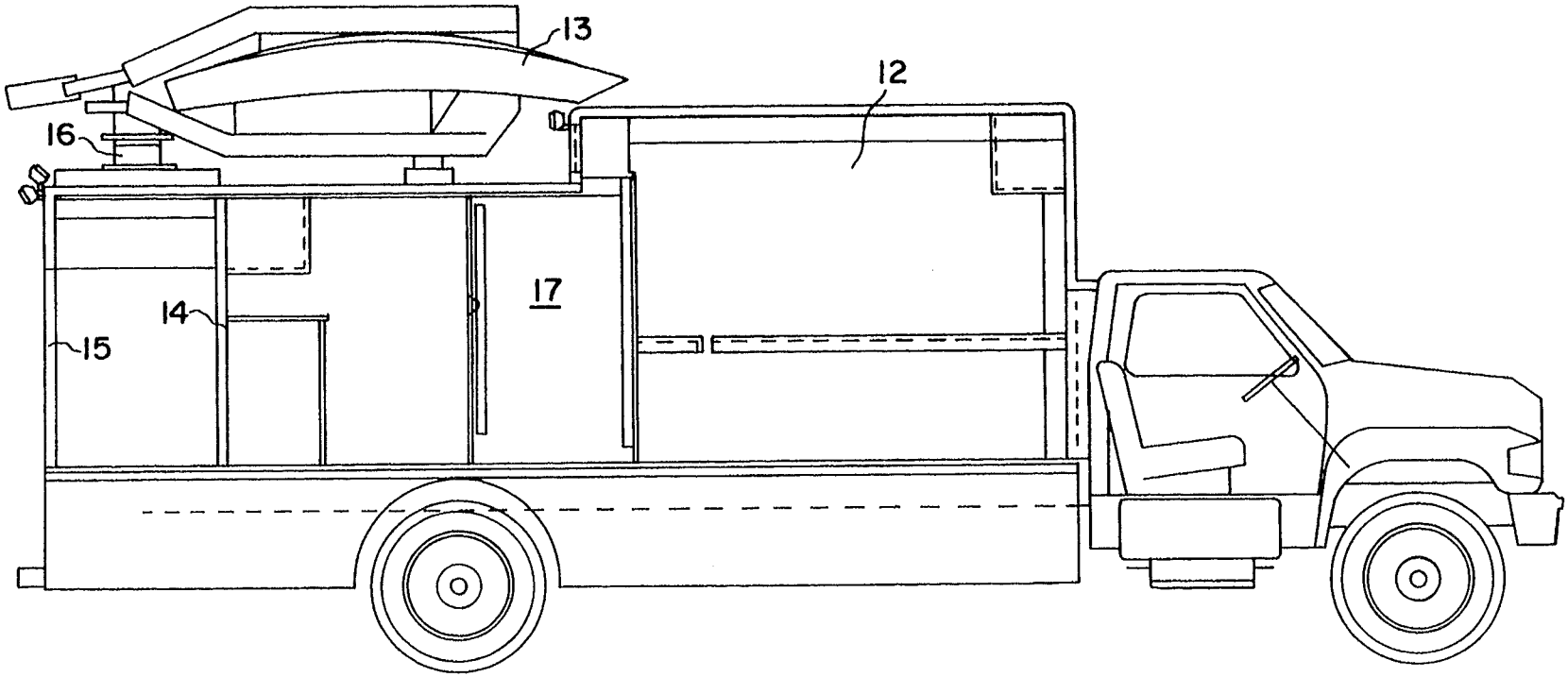
FIG. 1 PRIOR ART
FIG. 1 is a cross-sectional view of a communications vehicle in accordance with the prior art.
Figure 2:
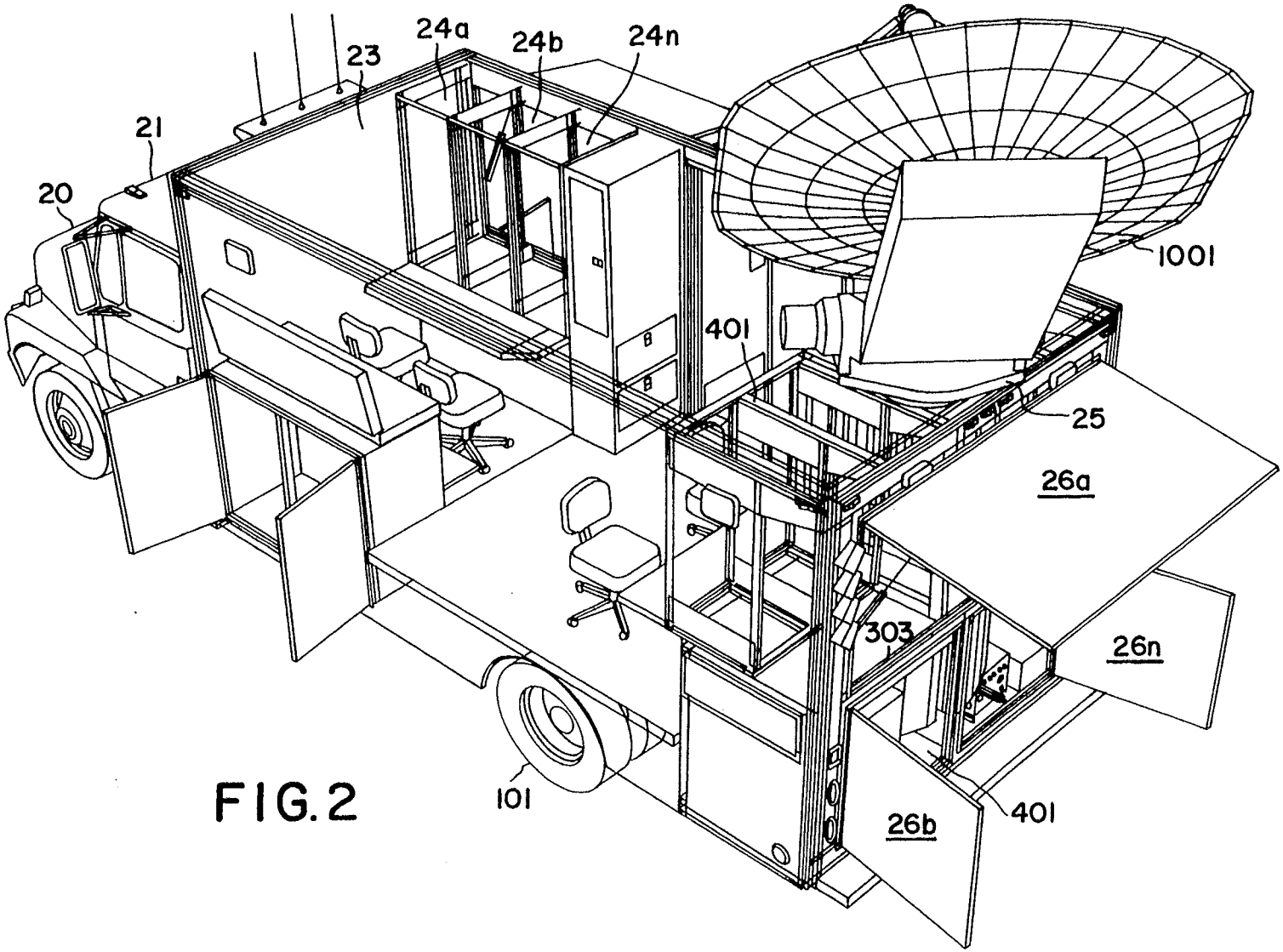
FIG. 2 is a perspective view of the interior of a communications vehicle taken from the street side rear corner in accordance with the present invention.

Turning first to FIG. 2, there is shown generally a communications vehicle 20 in accordance with the preferred embodiment of the present invention. The vehicle 20 includes a conventional cab 21 and a chassis 101. The operator compartment 23 includes a plurality of front racks 24a–24n and other furniture and fixtures necessary or desirable for the particular working environment, the particular location of which is subject to user discretion and only shown in FIG. 2 to exemplify one such arrangement. A satellite dish and aimer assembly 1001 is mounted on the roof of the vehicle 20 via satellite base 25. Access to the rear of the vehicle is provided through a plurality of doors 26a–26n.

FIGS. 3–9 show in sequential detail the structural support for the satellite dish/aimer. Suitable materials for the construction of the structural support of the present invention include stainless steel, steel and aluminum. Aluminum is particularly preferred in view of its strength and corrosion resistance. Although in the following description, aluminum is specified as the material of choice, it should be understood that the present invention is not to be so limited. It should also be understood that although specific dimensions of the various members of the structural support are recited, the same is only for purposes of illustration and is not to be construed as limiting.

Figure 3:
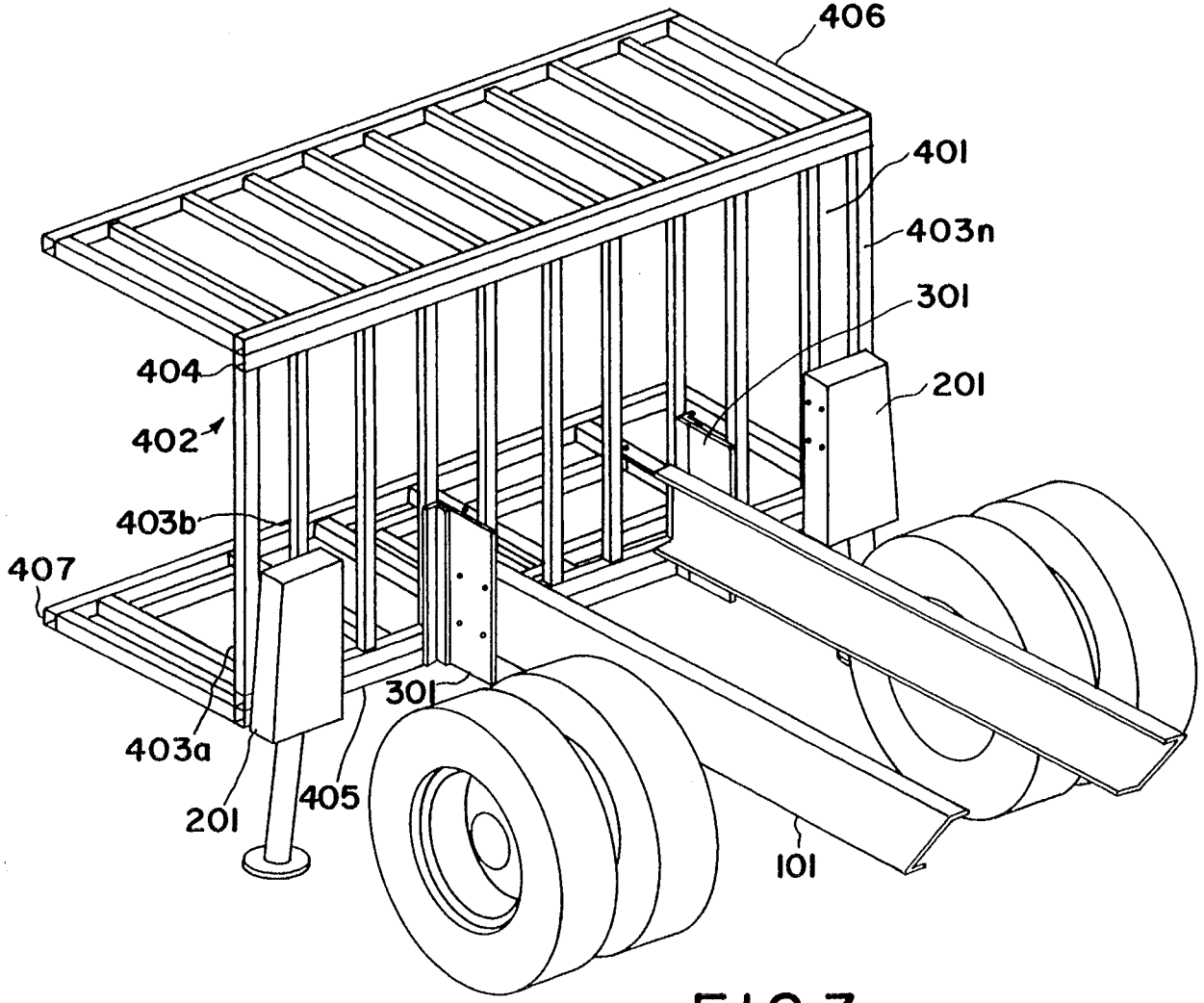
FIG. 3 is a perspective view of the rear enclosure of the structural support in accordance with the present invention.
Figure 11:
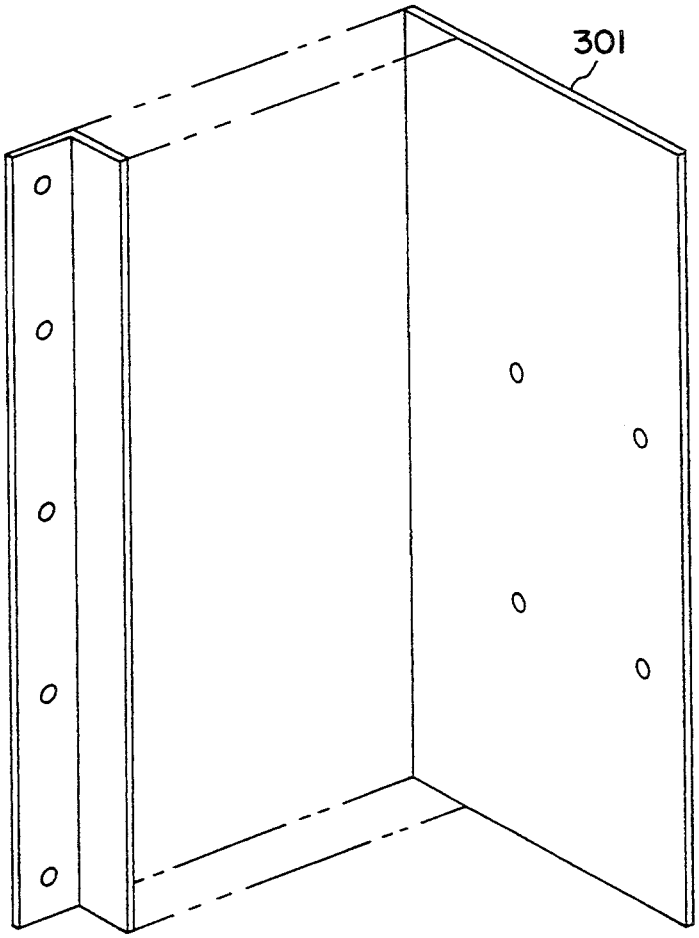
FIG. 11 is an exploded view of the plate for attaching the structural support assembly to the vehicle chassis in accordance with the present invention.

Turning to FIG. 3, vehicle chassis 101 is coupled to rear enclosure 401 via rear chassis attachments 301. Rear chassis attachments 301 are comprised of a steel plate 310 (FIG. 11) secured to the chassis 101, and a steel angle 320 which secures to the plate 310 and to a vertical member of the rear enclosure 401. A pair of retractable jacks 201 are also coupled to the rear enclosure 401 for support when the vehicle is idle.

Rear enclosure 401 includes a vertical bulkhead section 402 composed of a plurality of spaced vertical tubes 403a–403n secured to top cross member 404 and bottom cross member 405 such as by welding, and top and bottom horizontal sections 406, 407, each also composed of a plurality of spaced tubes welded to top and bottom members. The bottom section 407 may have assorted cut-outs and horizontal members in place of the vertical tubes to accommodate various elements in the vehicle. The top and bottom sections 406, 407 are secured to the vertical bulkhead by suitable means, such as welding.

Figure 4:
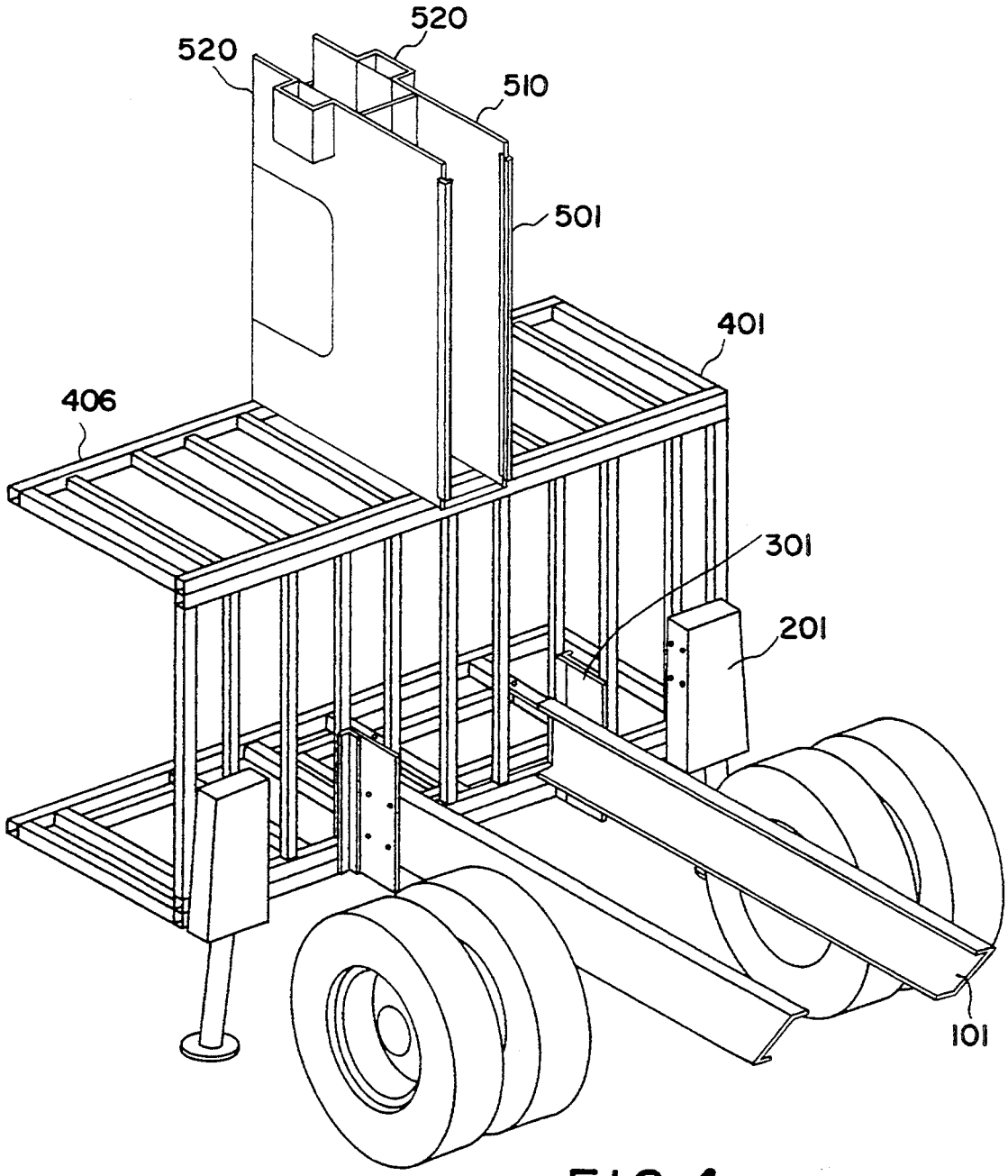
FIG. 4 is a perspective view of the rear enclosure of the structural support, including vertical dish supports in accordance with the present invention.
Figure 5:
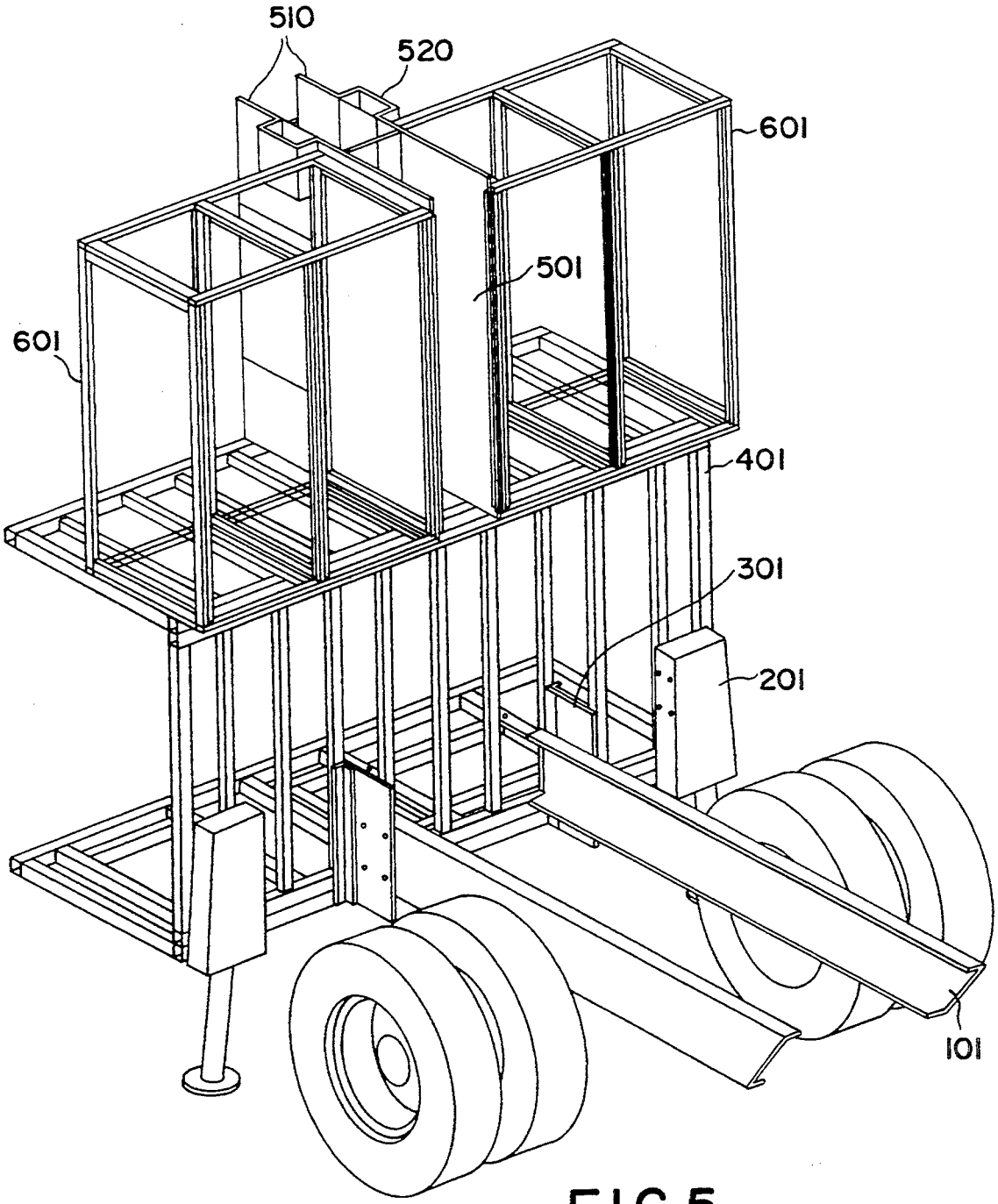
FIG. 5 is a perspective view of the rear enclosure of the structural support, including vertical dish supports and racks in accordance with the present invention.
Figure 12:
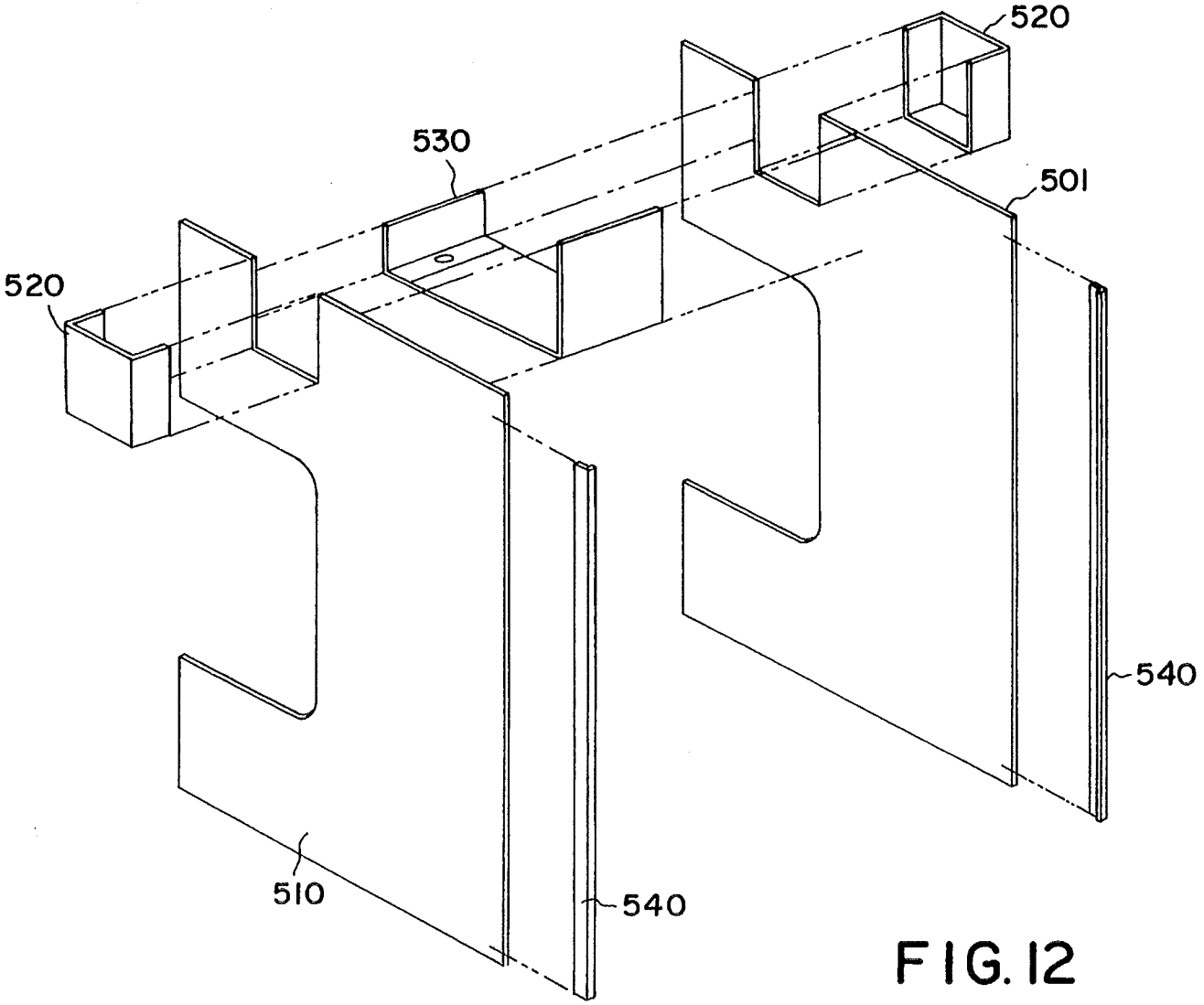
FIG. 12 is an exploded view of the vertical dish support plates in accordance with the present invention.

FIG. 4 illustrates vertical dish support assemblies 501 secured on the rear enclosure 401, and specifically, on the top horizontal section 406 thereof. The details of each vertical dish support assembly 501 are shown in FIG. 12. Each dish support assembly 501 consists of a dish support plate 510, a waveguide clearance extension 520, a central section water trap 530, and a rack angle 540 for supporting the racks (discussed in detail below). Preferably each dish support plate 510 is at least about $\frac{1}{4}''$ thick, and is made of aluminum (6061 alloy).

Figure 13:
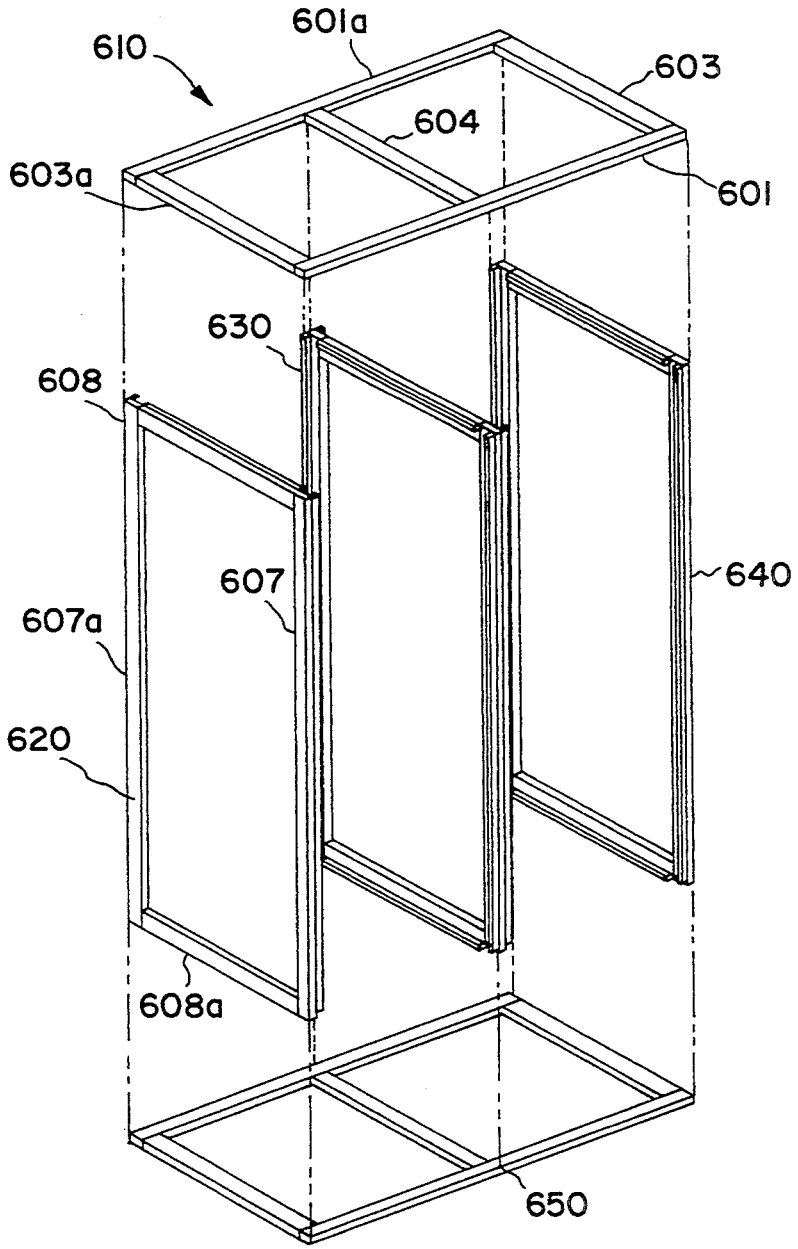
FIG. 13 is an exploded view of the electronics rack assembly in accordance with the present invention.

Secured to each vertical dish support assembly 501 and to the top horizontal section 406 of rear enclosure 401 is a rack 601 which can be used to house the electronics inside the communications vehicle. Each rack consists of a top rack frame 610, a bottom rack frame 650, and spaced vertical frames 620, 630 and 640 therebetween (essentially dividing each rack 601 into two racks), as shown in FIG. 13. The top and bottom rack frames 610 and 650 are each defined by two long vehicle rear and vehicle front $1\frac{1}{2}\times\frac{3}{4}\times\frac{1}{8}''$ aluminum tubes 601, 601a welded at each end to two short vehicle side $1\frac{1}{2}\times\frac{3}{4}\times\frac{1}{8}''$ aluminum tubes 603, 603a. A short intermediate $1\frac{1}{2}\times\frac{3}{4}\times\frac{1}{8}''$ aluminum tube 604 is secured between the two short side tubes 603, 603a. Between the top and bottom rack frames 610 and 650 are a plurality of spaced vertical rack frames 620–640. Each vertical rack frame is constructed of two long $1\frac{1}{2}\times\frac{3}{4}\times\frac{1}{8}''$ aluminum tubes 607, 607a and two short $1\frac{1}{2}\times\frac{3}{4}\times\frac{1}{8}''$ aluminum tubes 608, 608a fillet welded at inside corners and on the surfaces.

Figure 6:
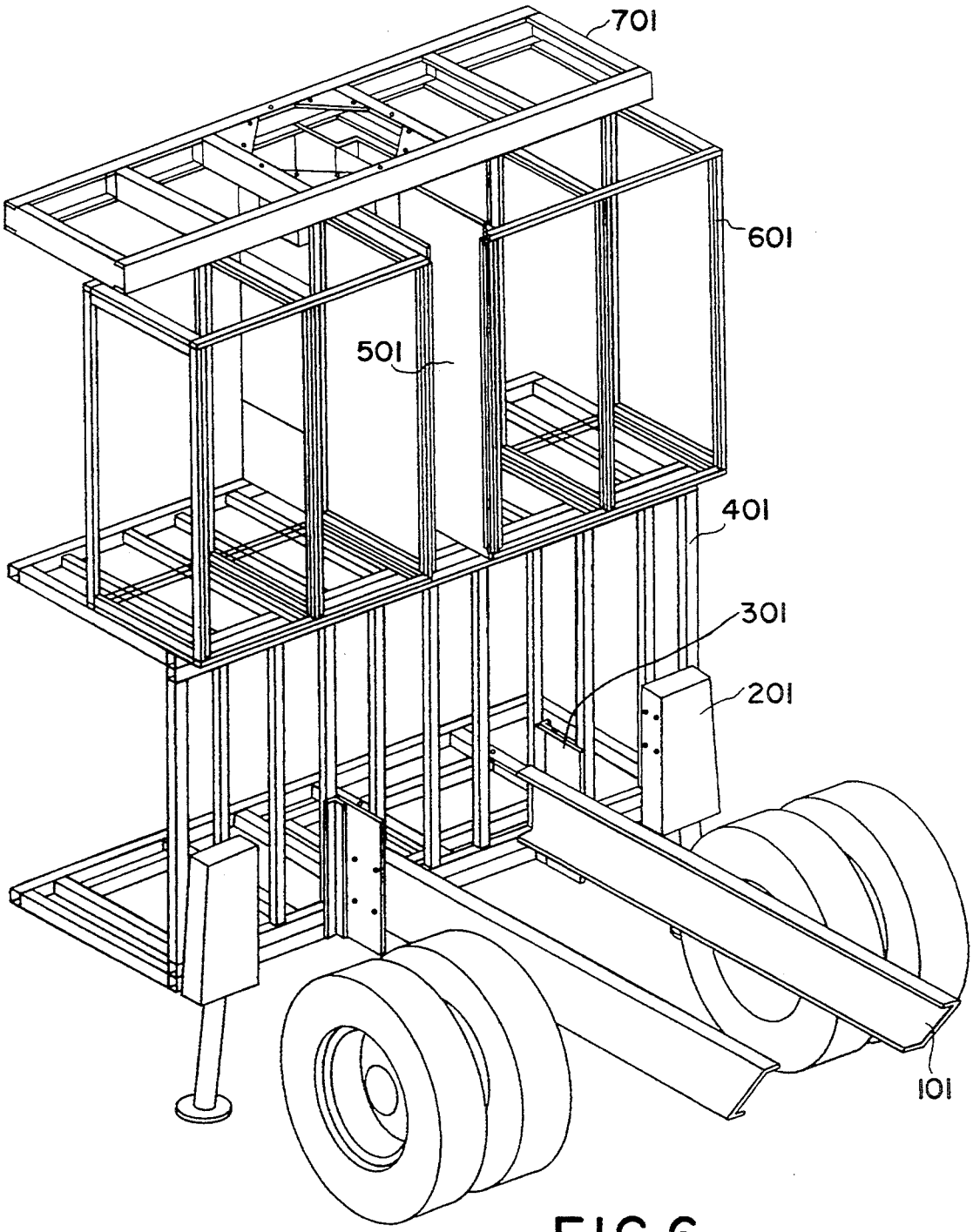
FIG. 6 is a perspective view of the rear enclosure of the structural support, including vertical dish supports, racks and dish area roof frame in accordance with the present invention.
Figure 14:
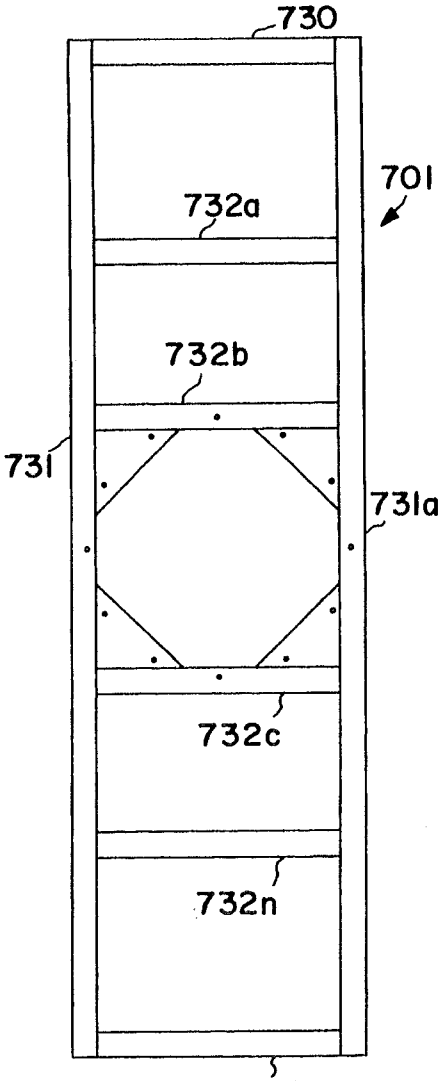
FIG. 14 is a top view of the dish area roof frame in accordance with the present invention.

Supported on racks 601 and vertical dish supports 501 is a dish area roof frame 701 as shown in FIG. 6. The perimeter of the dish area roof frame 701, as shown in FIG. 14, is constructed of two short vehicle side channels 730, 730a, long vehicle rear channel 731 and long vehicle front channel 731a, each being $4\times2\ \frac{1}{4}''$ assoc. standard aluminum channels welded into a framework as shown. A plurality of channel members 732a–732n are spaced in the framework as shown, each being fixed at its ends to front and rear channels 731, 731a. The satellite dish base 25 is supported at channels 732b, 732c, which are reinforced with triangular $\frac{1}{4}''$ aluminum braces 733a–733d welded into the frame flush on the topside thereof. The dish area roof frame 701 is attached to the roof front frame (not shown) by any suitable means, such as bolts securing the vehicle front channel 731a of dish area roof frame 701 to the vehicle roof forward frame.

Figure 7:
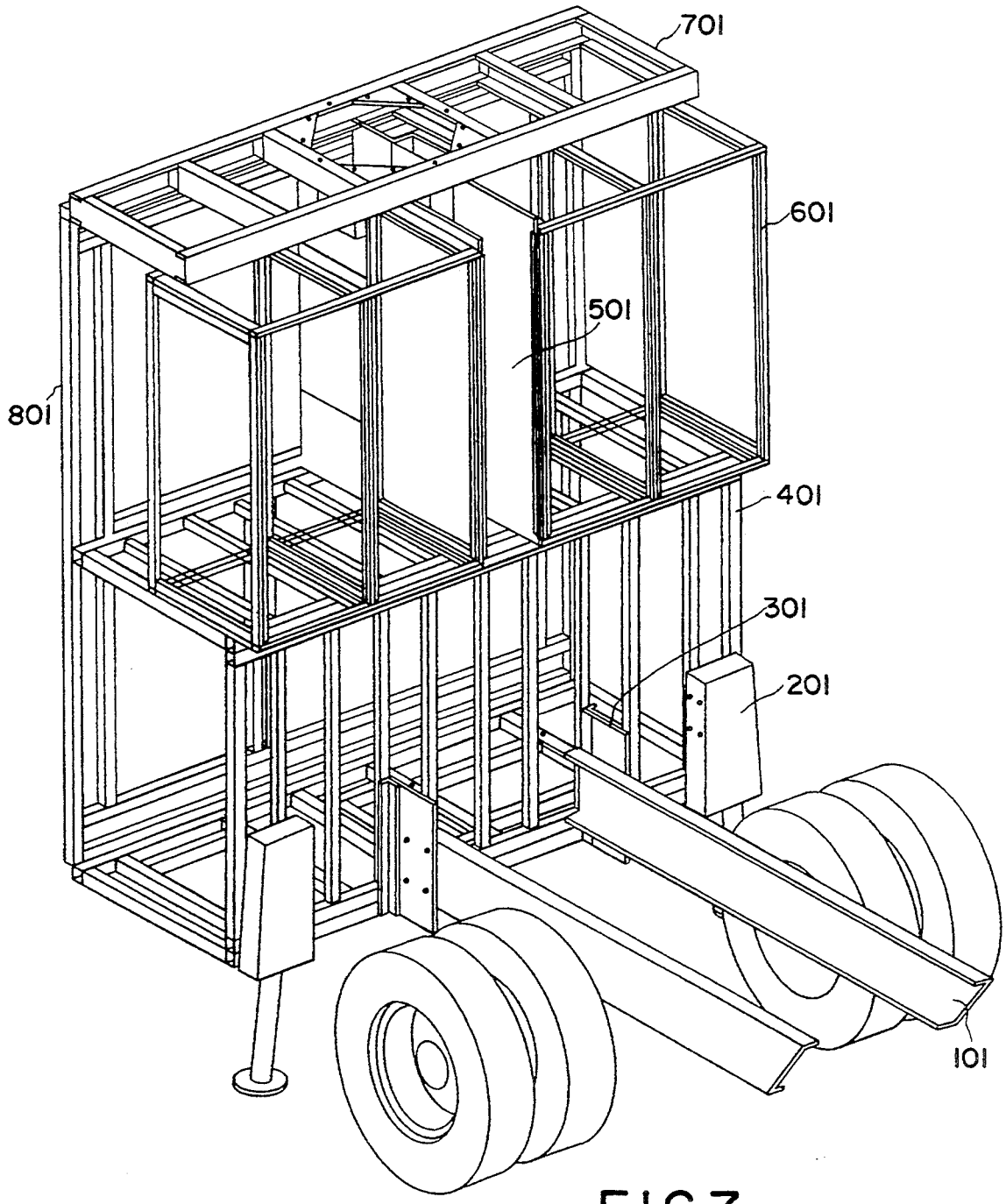
FIG. 7 is a perspective view of the rear enclosure of the structural support, including vertical dish supports, racks, dish area roof frame and rear wall assembly in accordance with the present invention.
Figure 15:
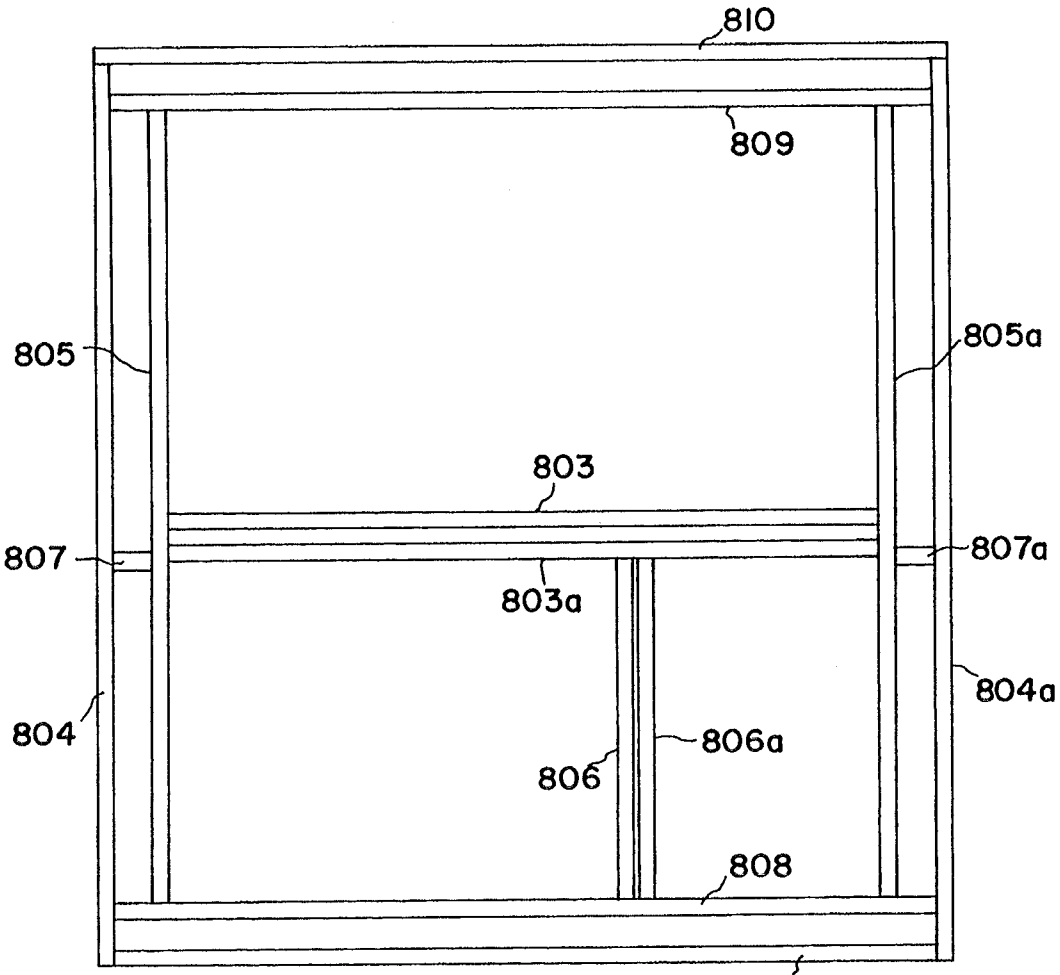
FIG. 15 is front view of the rear vehicle wall in accordance with the present invention.

FIG. 7 shows the structural support assembly with the rear wall assembly 801 in place. The details of the rear wall assembly 801 framework are shown in FIG. 15. The rear wall 801 is constructed from a combination of $1\frac{3}{4}\times1$, $\frac{3}{4}\times0.065$ stainless steel frame fillet welded at all intersections and surface welded opposite the fillets at the outer verticals, then ground flush. The frame 801 is defined by a top horizontally oriented frame tube 810 welded at each end to vertical frame tubes 804 and 804a, and a bottom horizontally oriented frame tube 802 welded at each end to the bottom ends of the vertical frame tubes 804 and 804a as shown. Bottom inner frame tube 808 of similar length to tube 802 is secured to the vertical frame tubes 804 at a position vertically spaced from bottom frame tube 802. Similarly, top inner frame tube 809 of similar length to bottom frame tube 802 is secured to the vertical frame tubes 804 and 804a at a position vertically spaced from top frame tube 801. Preferably inner frame tubes 808 and 809 are spaced from frame tubes 802 and 801, respectively, a distance of about 3.5 inches. Inner vertical tubes 805 and 805a are secured to inner frame tubes 808 and 809 at a position horizontally spaced from vertical frame tubes 804 and 804a, respectively. Preferably this horizontal space is about 4.125 inches, fixed by spacer tubes 807, 807a. The outside dimensions of the frame in the embodiment shown are $91\ 7/16''\times101''$.

Intermediate top and bottom inner frame tubes 808 and 809 are two spaced horizontal support tubes 803, 803a secured to inner vertical frame tubes 805, 805a. Intermediate inner vertical frame tubes 805, 805a are two spaced vertical tubes 806, 806*a* secured at their top ends to horizontal support tube 803*a* and at their bottom ends to inner frame bottom tube 808. It should be understood by those skilled in the art that the particular orientation of the various tubes can be modified, depending upon the desired configuration of the compartments which they define, so long as the structural integrity of the assembly is not weakened. The particular configuration of the frame as described above is designed to provide access to the rear interior of the vehicle, as shown in FIG. 2.

Figure 8:
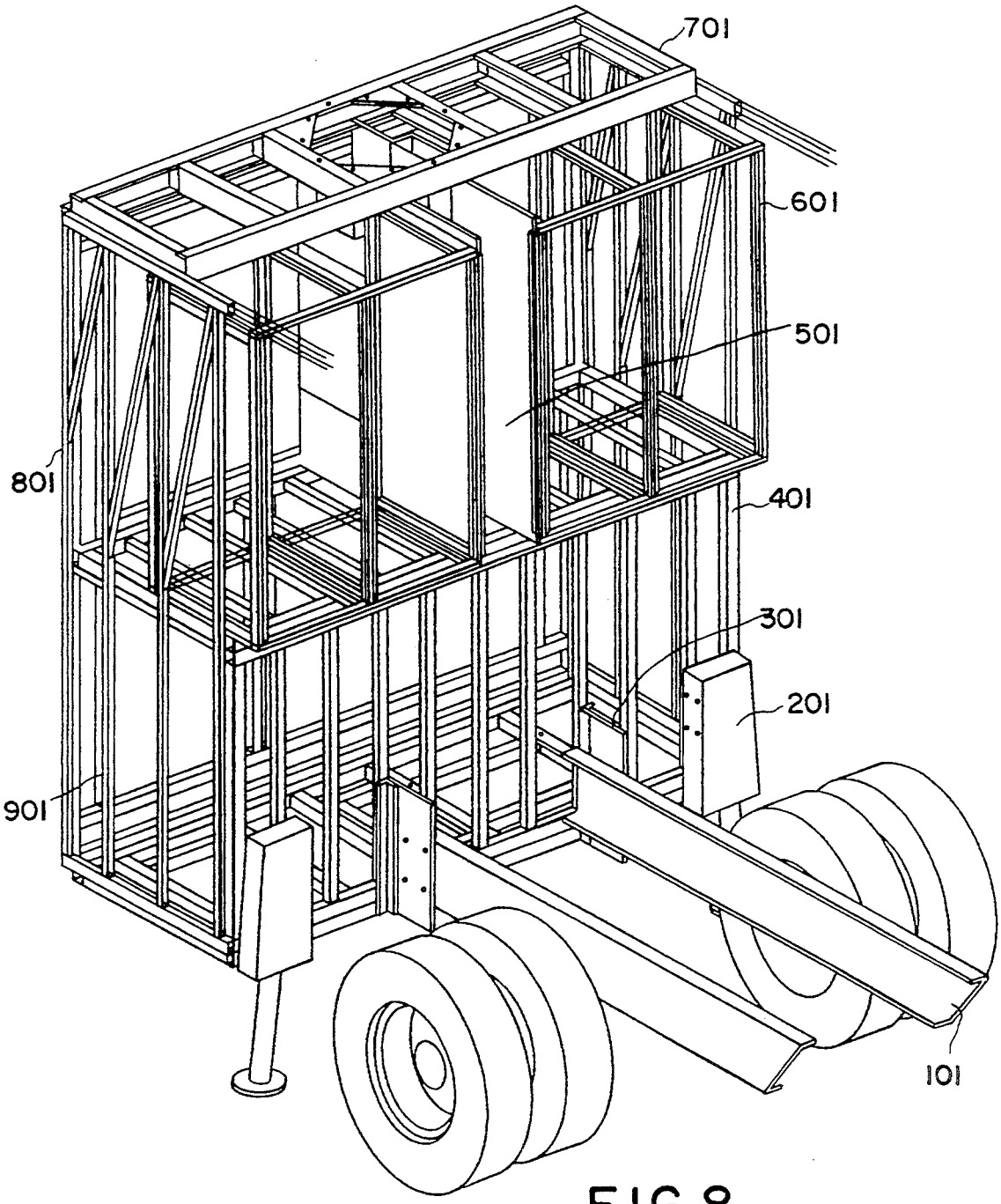
FIG. 8 is a perspective view of the rear enclosure of the structural support, including vertical dish supports, racks, dish area roof frame, rear wall assembly and side wall assemblies in accordance with the present invention.
Figure 16:
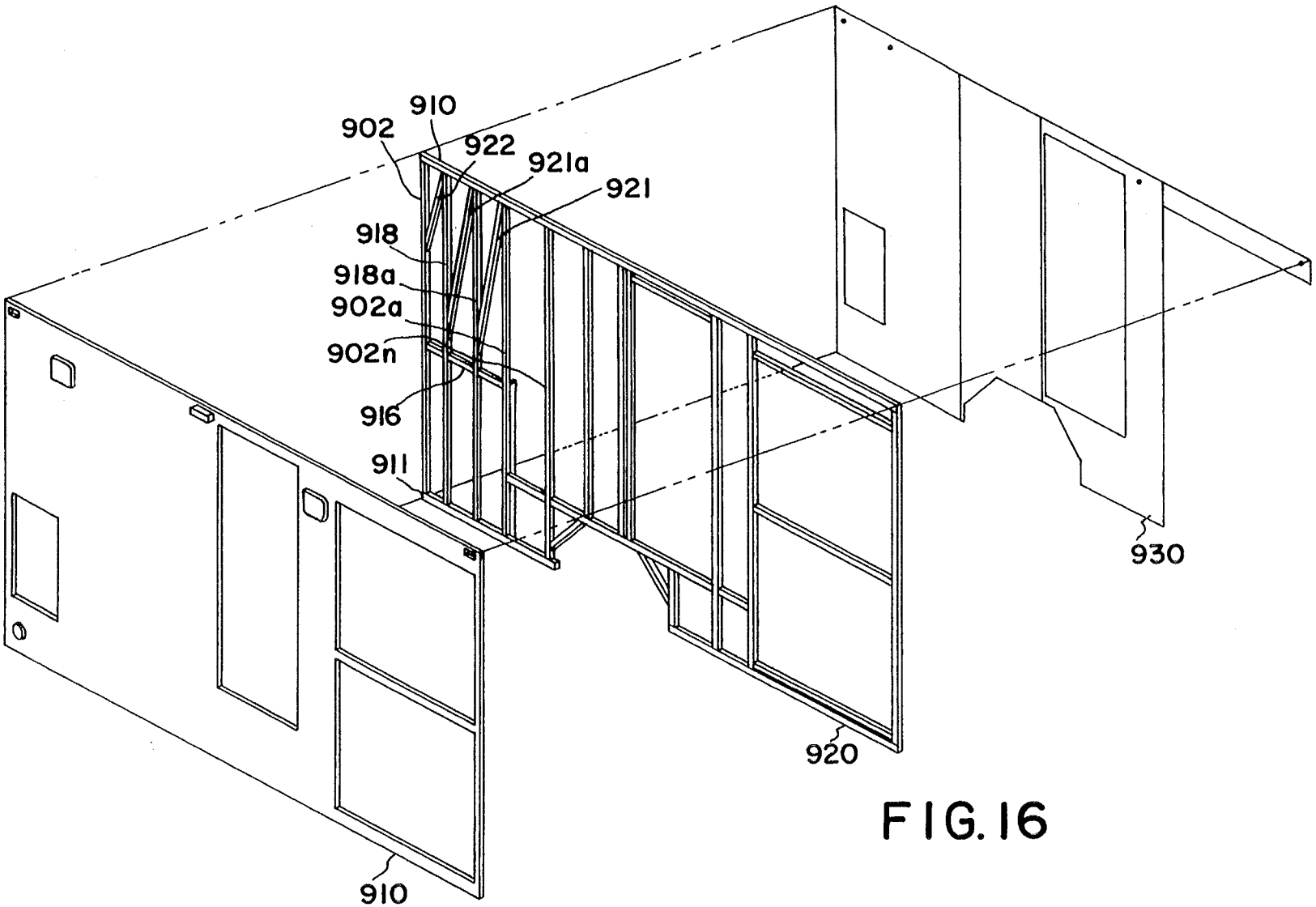
FIG. 16 is an exploded view of the side wall framework in accordance with the present invention.

FIG. 8 shows the structural support assembly with the side walls 901 partially shown. Reference to FIG. 16 shows the complete sidewall 901 framework (street side view). It should be understood by those skilled in the art that the other side wall (street side view) is of similar configuration in the rear portion supporting the dish assembly, and that the particular configuration of the remainder of the side wall can vary, depending upon the access needed or desired into the vehicle. Each sidewall acts as a support member, providing support for the dish and aimer assembly 1001. Each sidewall skin acts a membrane. The frame is defined by a rear vertical stainless steel tube (1×2×0.065) 902 welded at its top end to top stainless steel tube (1×2×0.065) 910 and at its bottom end to bottom stainless steel tube (1×2×0.065) 911. A plurality of vertically oriented stainless steel tubes 902*a*–902*n* of similar length to tube 902 are also welded to top tube 910 and bottom tube 911 at spaced intervals as shown. The space between tubes 902 and 902*a* is where much of the support for the satellite dish assembly is required. To provide such support, a pair of stainless steel tube supports 918, 918*a* are secured to top tube 910 and bottom tube 911, and one or more spacer braces 916 are secured therebetween as shown. Angled tube 921 extends from the intersection of tube 902*a* and top tube 910 to the intersection of spacer brace 916 and tube support 918*a* at an angle of about 79° from the horizontal. Similarly, angled tube 921*a* extends from the intersection of tube support 918*a* and top tube 910 to the intersection of spacer brace 916 and tube support 918 at an angle of about 79° from the horizontal. Short angled tube 922 extends from the intersection of tube support 918 and top tube 910 to tube 902 at an angle of about 77° from horizontal. The various tubes that make up each sidewall act as stiffeners.

Figure 17:
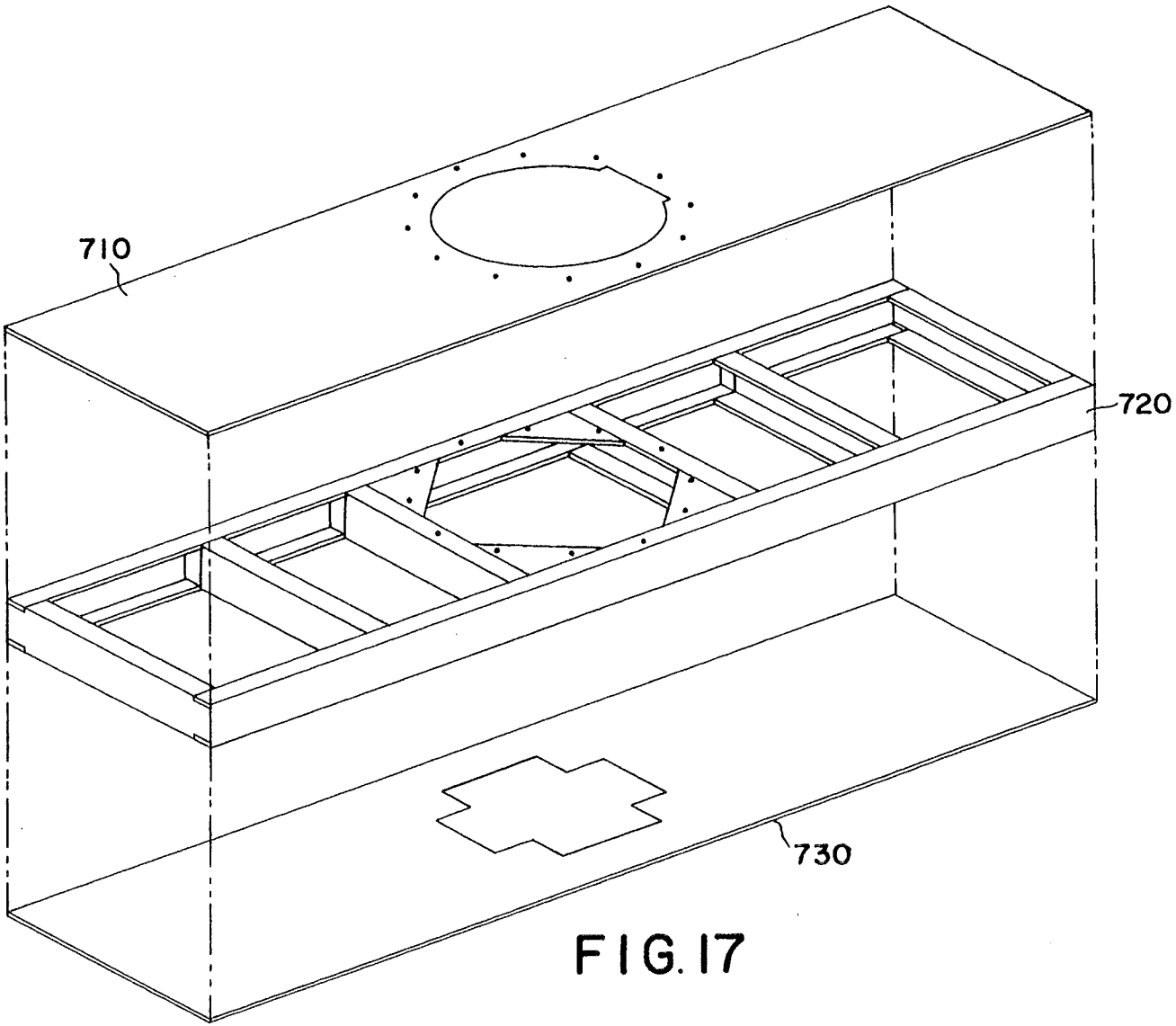
FIG. 17 is an exploded view of the rear roof framework and skin assembly in accordance with the present invention.

Also playing an integral role in the support of the satellite dish assembly 1001 are the structural support assembly and vehicle interior wall skins or membranes. FIG. 17 illustrates the rear roof 701 top skin 710 and bottom skin 730, dimensioned to fit over rear roof framework 720 as shown. The top and bottom skins can be secured to the framework by any suitable means, such as by riveting.

Figure 18:
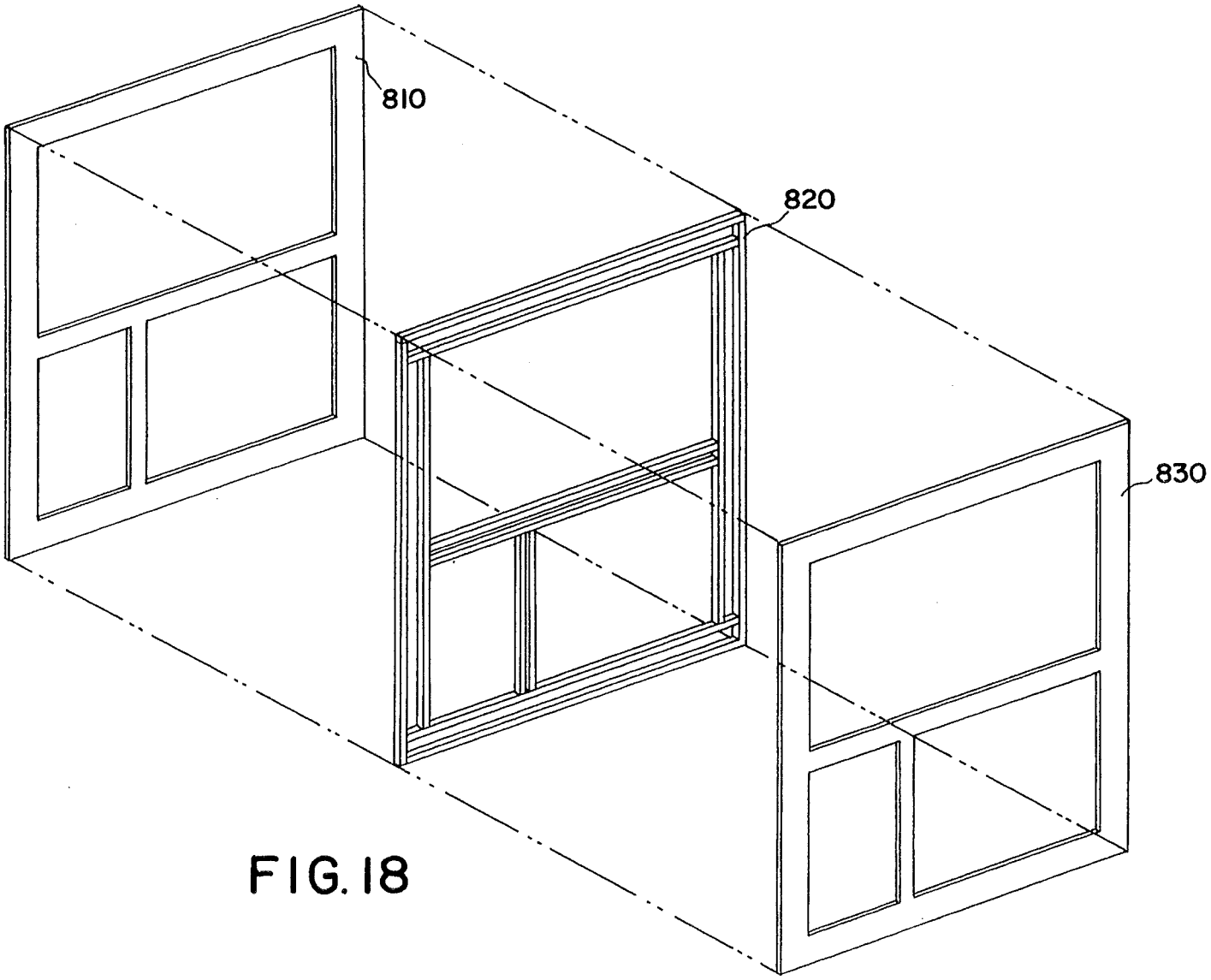
FIG. 18 is an exploded view of the rear wall framework and skin assembly in accordance with the present invention.

FIG. 18 shows the rear wall framework 820 with rear wall interior skin 830 and exterior skin 810 dimensioned to fit over rear wall framework 820 as shown. The rear wall interior and exterior skins can be secured to the framework by any suitable means, such as by riveting.

Figure 19:
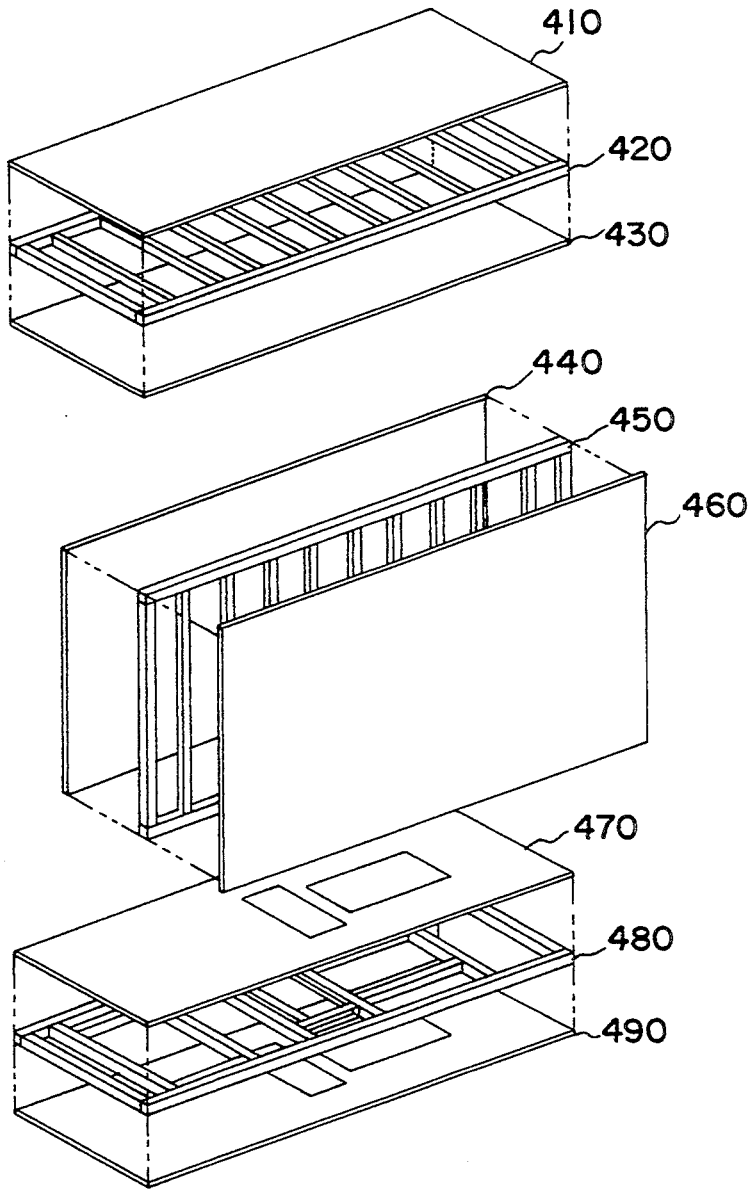
FIG. 19 is an exploded view of the rear enclosure framework and skin assembly in accordance with the present invention.

FIG. 19 shows the skins secured to each section of the rear enclosure 401. Top horizontal section top skin 410 and top horizontal section bottom skin 420 are secured to top horizontal section 406. Vertical bulkhead rear skin 440 and vertical bulkhead forward skin 460 are secured to vertical bulkhead section 402. Bottom horizontal section top skin 470 and bottom horizontal section bottom skin 490 are secured to bottom horizontal section 407.

FIG. 16 shows the interior and exterior side wall skins 930, 940, which are secured to the side wall framework 920.

The interior skins are preferably formed of 0.063 6061 aluminum and assist in the structural support. The exterior skins are preferably formed of fiberglass, and are sealed to the perimeter frame by suitable means, such as caulking.

Figure 9:
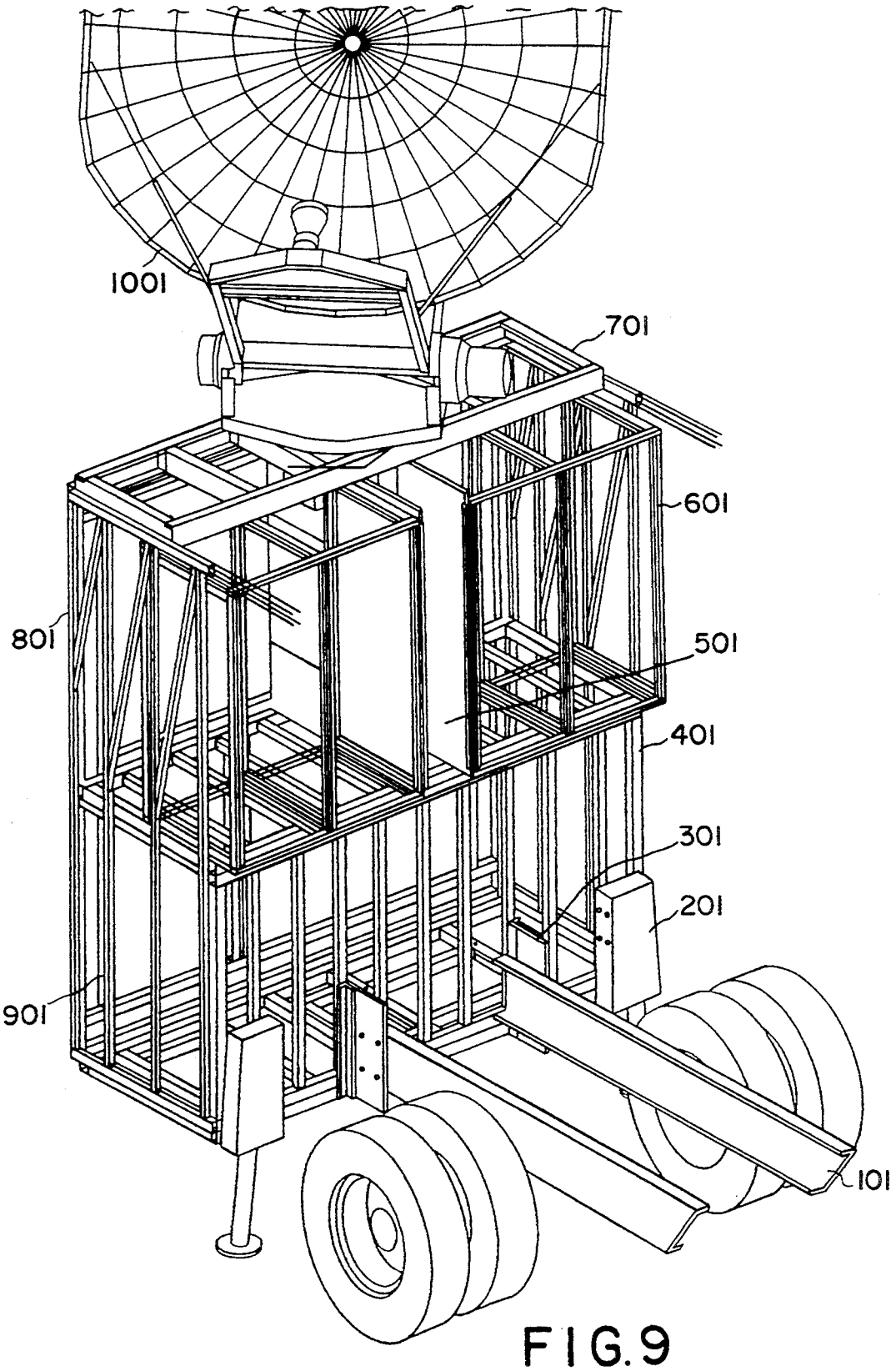
FIG. 9 is a perspective view of the rear enclosure of the structural support, including vertical dish supports, racks, dish area roof frame, rear wall assembly, side wall assemblies and satellite dish in accordance with the present invention.
Figure 10:
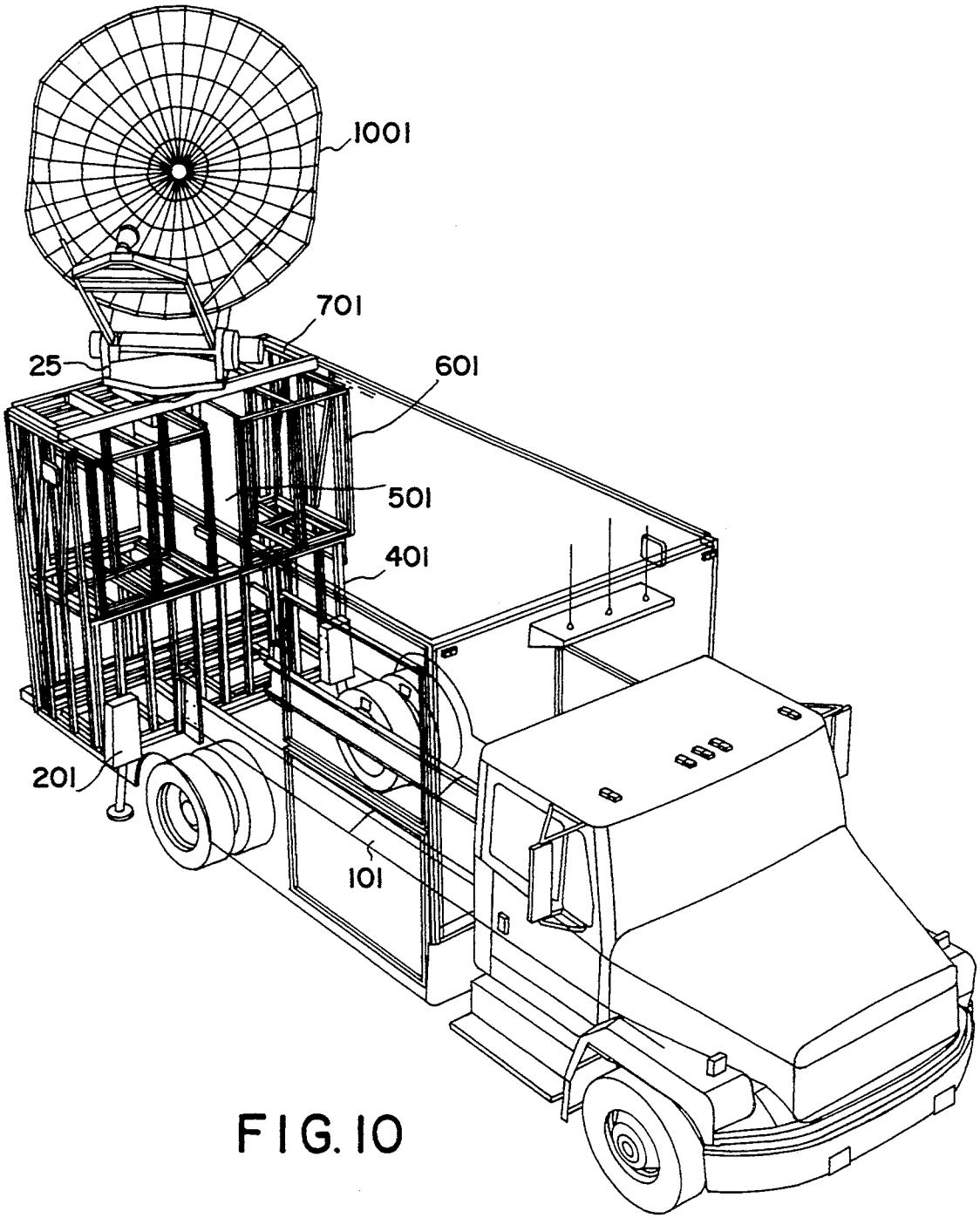
FIG. 10 is a perspective view of the vehicle showing the dish and structural support system in accordance with the present invention.

The foregoing structural assembly supports satellite dish assembly 1001, as shown in FIG. 9. The dish 1001 includes dish aimer or base 25, which is secured to the dish area roof frame 701. Load from the satellite dish assembly is transmitted through the dish area roof frame 701, to the racks 601, side walls 901 (including interior skins), rear wall 801, vertical dish supports 501, rear enclosure 401, vehicle chassis 101, and jacks 201, and finally to the ground.

Strategic positioning of the electronics racks to help support the satellite dish assembly 1001 while still allowing easy access from the operator compartment of the vehicle, results in the maximization of operation compartment space for any given vehicle dimensions.

What is claimed is:

1. In a communications vehicle having a chassis, two side walls, a rear wall, and a roof, a support structure for a satellite dish assembly, comprising:

a rear enclosure assembly mounted on said chassis, said rear enclosure assembly comprising a bulkhead wall and top and bottom horizontal sections each secured to said bulkhead wall;

jack means mounted on said rear enclosure assembly;

a pair of vertical dish supports secured to said top horizontal section of said rear enclosure;

a first rack assembly secured to said top horizontal section of said rear enclosure and to one of said vertical dish supports;

a second rack assembly spaced from said first rack and secured to said top horizontal section of said rear enclosure and to the other of said vertical dish supports;

a dish area roof frame supported on said pair of vertical dish supports, said first and second racks, and said rear and side walls; and a satellite dish assembly mounted on said dish area roof frame.

2. The support structure of claim 1, wherein each of said vehicle side walls comprises a plurality of angled members extending from said vehicle roof toward said vehicle chassis at about a 79° angle.

3. The support structure of claim 2, wherein each of said vehicle side walls further comprises an angled member extending from said vehicle roof toward said vehicle chassis at about a 77° angle.

4. The support structure of claim 1, wherein said first and second rack assemblies extend beyond said bulkhead in the direction toward the front of said vehicle.

* * * * *